US007793782B2

(12) United States Patent
Chuang

(10) Patent No.: US 7,793,782 B2
(45) Date of Patent: Sep. 14, 2010

(54) CARRYING CASE WITH A MAGNETIC RETAINING STRUCTURE FOR RECEIVING AN OBJECT IN A SUSPENDED STATE

(76) Inventor: Yao-Tang Chuang, No. 64, Lane 111, Ching Ping Road, Chunghe City, Taipei Hsien (TW)

( * ) Notice: Subject to any disclaimer, the term of this patent is extended or adjusted under 35 U.S.C. 154(b) by 315 days.

(21) Appl. No.: 11/684,650

(22) Filed: Mar. 12, 2007

(65) Prior Publication Data

US 2008/0223676 A1 Sep. 18, 2008

(51) Int. Cl.
*A45C 13/02* (2006.01)

(52) U.S. Cl. ..... 206/320; 206/523; 206/818; 190/33

(58) Field of Classification Search ..... 190/102, 190/13 H, 14, 15 R, 33; 206/329, 818, 523, 206/283, 320; 312/334.23; 211/126.15; 446/133; 220/559, 560
See application file for complete search history.

(56) References Cited

U.S. PATENT DOCUMENTS 4,787,488 A * 11/1988 Campanini ..... 190/104
5,351,812 A * 10/1994 Eagon ..... 206/1.7
5,375,898 A * 12/1994 Ohmori et al. ..... 294/88
5,494,157 A * 2/1996 Golenz et al. ..... 206/320
5,622,262 A * 4/1997 Sadow ..... 206/522
5,775,497 A * 7/1998 Krulik ..... 206/320
5,996,749 A * 12/1999 Hillsberg et al. ..... 190/109
6,196,405 B1 * 3/2001 Kambouris ..... 220/4.22
6,229,422 B1 * 5/2001 Pignataro ..... 335/289
6,827,185 B2 * 12/2004 Scicluna ..... 190/110
2002/0027052 A1 * 3/2002 Godshaw et al. ..... 190/111
2003/0234476 A1 * 12/2003 Enoki et al. ..... 267/136
2004/0233026 A1 * 11/2004 Cardone ..... 335/285
2005/0161360 A1 * 7/2005 Chen ..... 206/449
2007/0029218 A1 * 2/2007 Picot et al. ..... 206/320

* cited by examiner

*Primary Examiner*—Sue A Weaver

(57) ABSTRACT

A carrying case includes a retaining structure including outer and inner surfaces, an intermediate first flexible board, a first padding between the outer surface and the first flexible board, a lower magnetic member between the inner surface and the first flexible board, and two longitudinal openings on either side proximate either end of a bottom; and a suspension plate including lower and upper surfaces, an upper magnetic member having a polarity opposing that of the lower magnetic member, a second flexible board on the upper magnetic member, a second padding between the upper surface and the second flexible board, and two spaced latches projecting from either end into the openings. The weight of a received object (e.g., notebook computer) pushes the suspension plate to slide down the latches along the openings, and the repelling force between the magnetic member counteracts the effects of the weight to suspend the suspension plate.

2 Claims, 5 Drawing Sheets

CARRYING CASE WITH A MAGNETIC RETAINING STRUCTURE FOR RECEIVING AN OBJECT IN A SUSPENDED STATE

BACKGROUND OF THE INVENTION (a) Technical Field of the Invention

The invention relates to carrying cases and more particularly to a carrying case having a magnetic retaining structure for receiving a precious or fragile object (e.g., a notebook computer, an electronic device, a camera, an antique or the like) in a suspended state by applying a repelling force against the weight of the objects (e.g., a notebook computer, an electronic device, a camera, an antique or the like).

(b) Description of the Prior Art

It is typical for a person to handle a precious or fragile object (e.g., a notebook computer, an electronic device, a camera, an antique or the like) with care while carrying. Thus, a wide variety of protective cases for containing the above objects are commercially available.

Notebook computers are widely popular among computer users in recent years due to their lightweight and thus portability. For the protection of a notebook computer, a wide variety of notebook computer cases are commercially available.

A typical notebook computer case comprises a main body and a padded retaining wall for receiving a notebook computer. However, the conventional padding cannot fully protect the notebook computer from being damaged due to falling, collision and the like.

Also, there have been numerous suggestions in prior patents for notebook computer case. For example, U.S. Pat. No. 5,607,054 discloses a folio carrying case for a notebook computer. The carrying case, in one position, serves as a protective cover for safely transporting a notebook computer and, in another position, serves as a computer stand for supporting the notebook computer in an ergonomic position.

Thus, continuing improvements in the exploitation of carrying case for a precious or fragile object (e.g., a notebook computer, an electronic device, a camera, an antique or the like) are constantly being sought.

SUMMARY OF THE INVENTION

The primary purpose of the present invention is to provide a carrying case having a magnetic retaining structure for receiving a precious or fragile object (e.g., a notebook computer, an electronic device, a camera, an antique or the like) in a suspended state by applying a repelling force against the weight of the notebook computer.

The above and other objects, features and advantages of the invention will become apparent from the following detailed description taken with the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
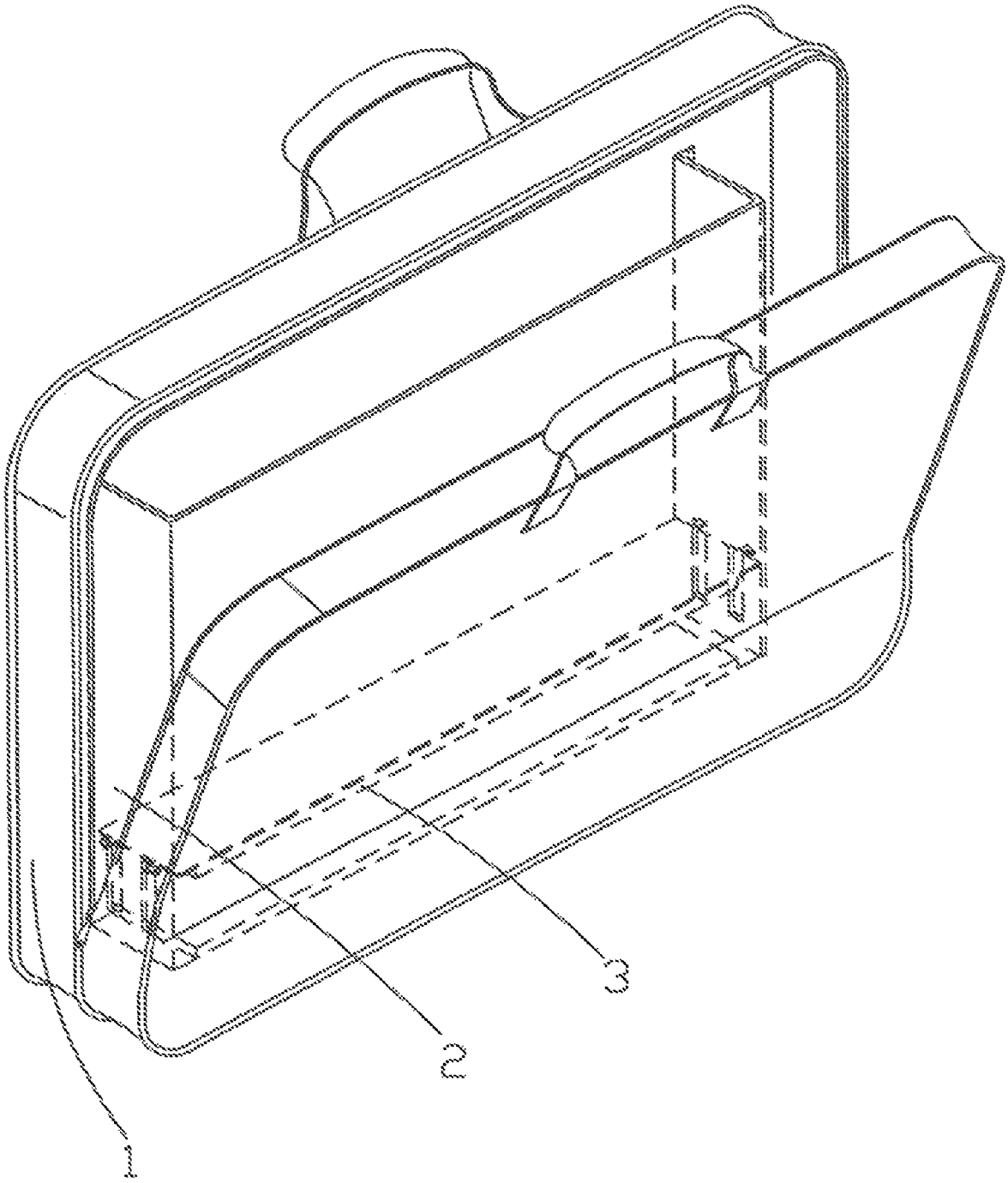
FIG. 1 is a perspective view of a preferred embodiment of carrying case according to the invention in an open position.
Figure 2:
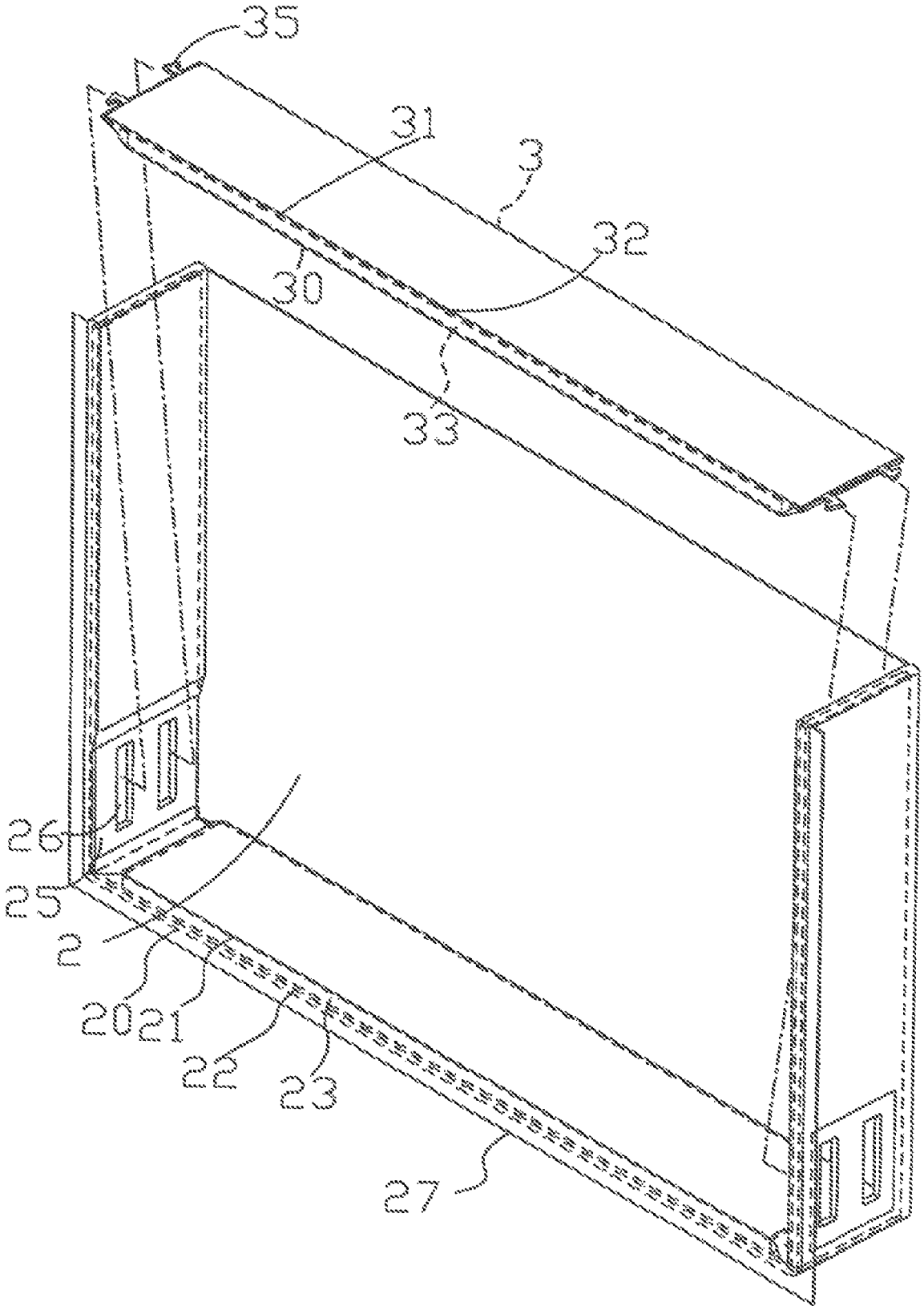
FIG. 2 is an exploded perspective view of the retaining structure and the suspension member.
Figure 3:
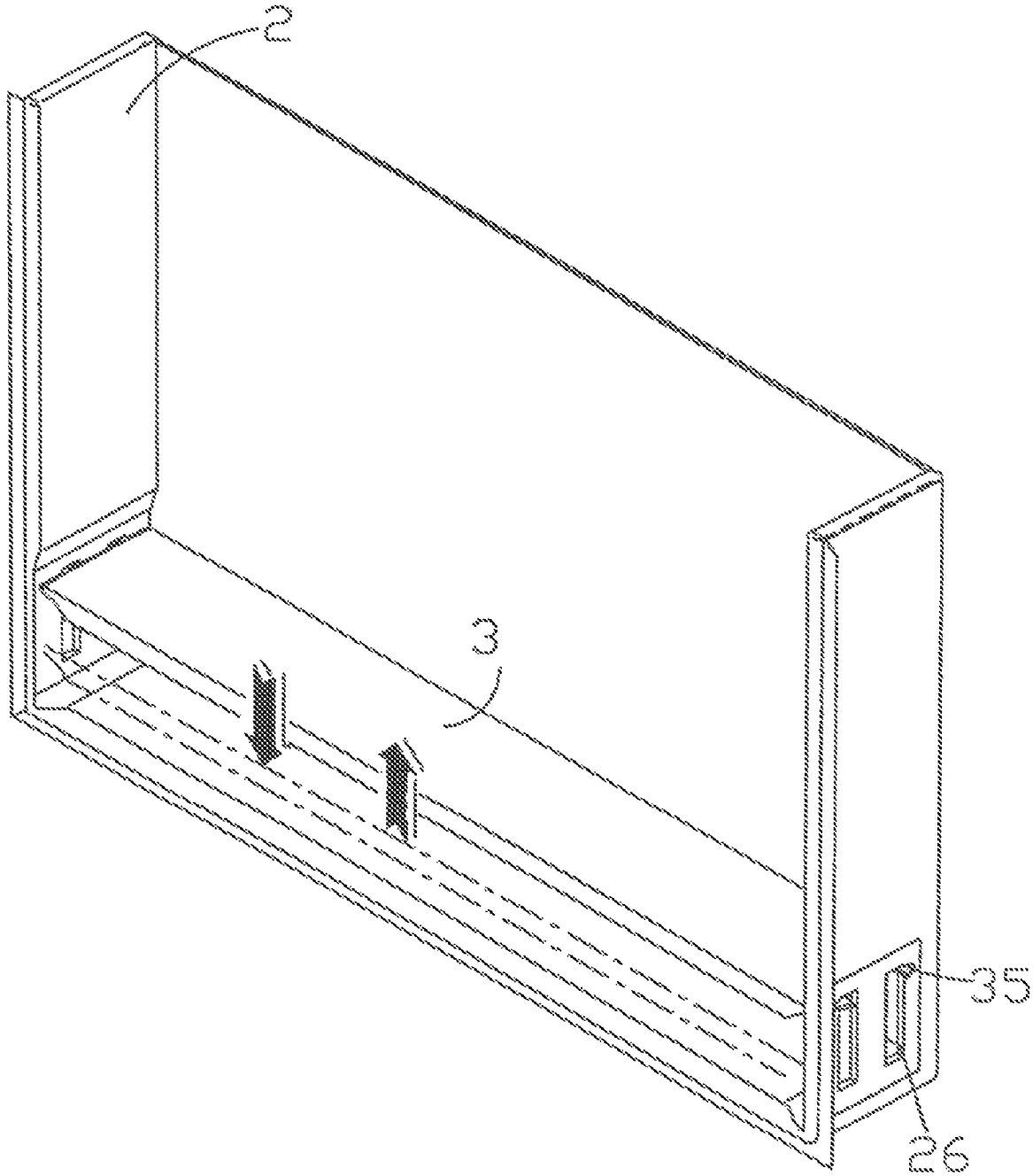
FIG. 3 is a perspective view of the assembled retaining structure and the suspension member shown in FIG. 2.
Figure 4:
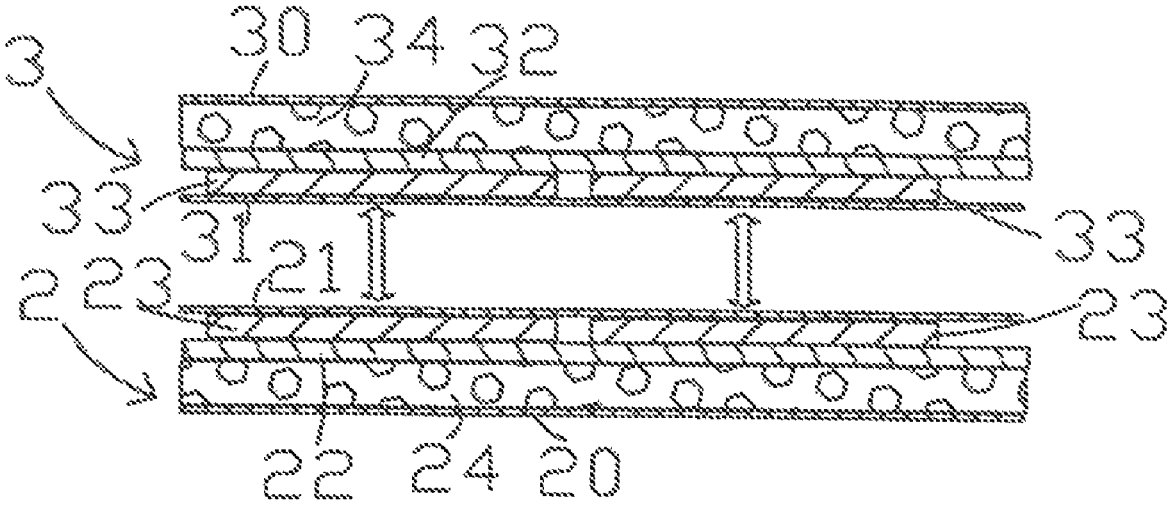
FIG. 4 is a sectional view of the retaining structure and the suspension member shown in a lower part of FIG. 3.
Figure 5:
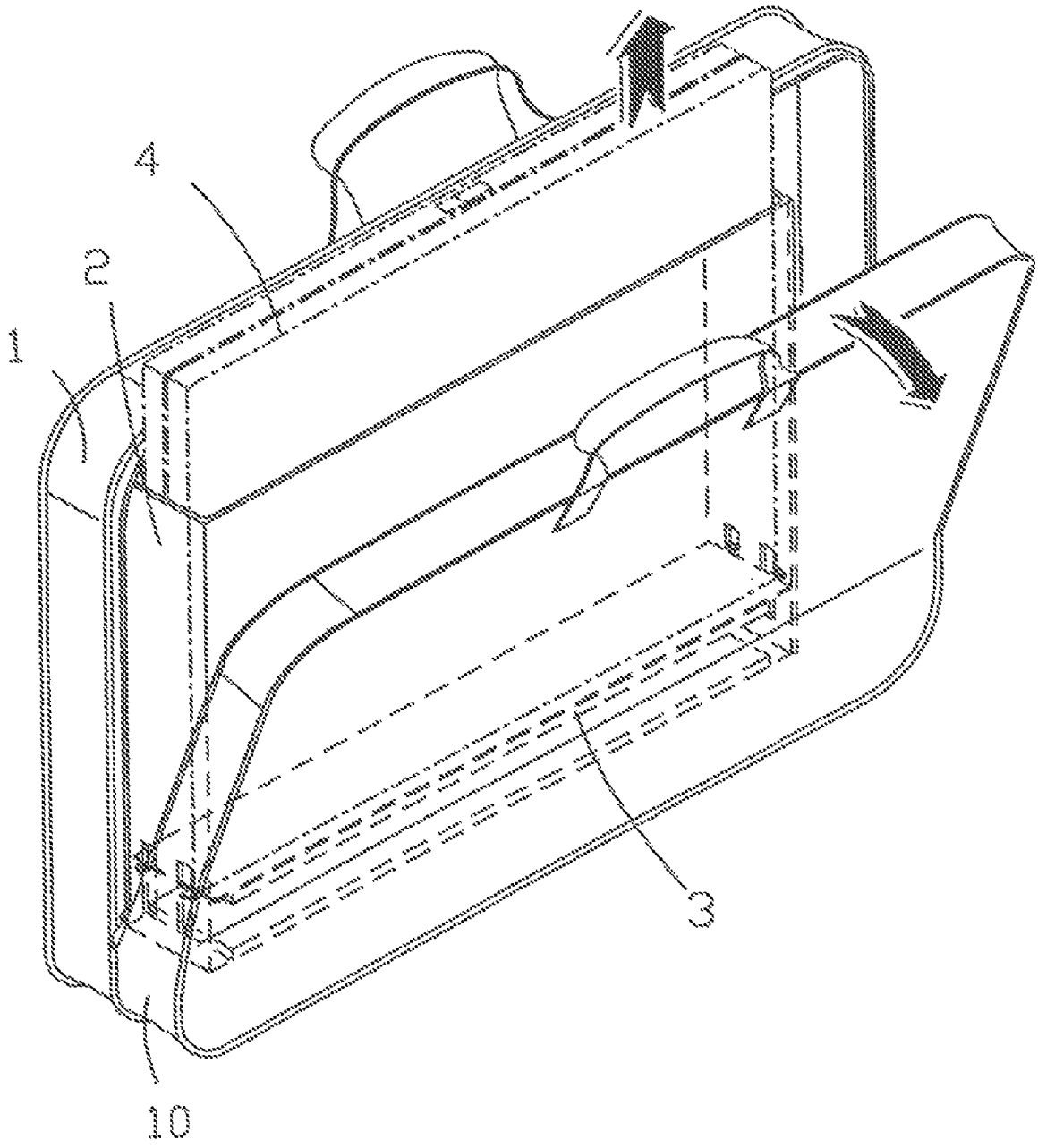
FIG. 5 is a perspective view of the open carrying case with a notebook computer being received in a suspended state.

Referring to FIGS. 1 to 5, a carrying case in accordance with a preferred embodiment of the invention is shown. In the following description, a notebook computer as an exemplary example is taken as an object to be protected by the carrying case of the invention. However, the carrying case of the invention is applicable to protect any other precious or fragile object (e.g., an electronic device, a camera, an antique or the, an electronic device, a camera, an antique or the like) in other embodiment. The carrying case comprises a main body 1 of substantially rectangular configuration, an internal retaining structure 2, and a suspension member 3 of substantially rectangular plate configuration. Each component is discussed in detailed below.

The main body 1 comprises an outer fabric 10 and a padded inner surface. The retaining structure 2 has a section of U and is dimensioned and shaped to receive a notebook computer 4. The retaining structure 2 comprises an outer fabric 20, an inner fabric 21, an intermediate flexible board 22, a padding 24 sandwiched between the outer fabric 20 and the flexible board 22, a lower magnetic member 23 of a first polarity sandwiched between the inner fabric 21 and the flexible board 22, two rectangular projecting members 25 on both sides in proximity to either end of a bottom 27, and two parallel rectangular openings 26 on either projecting member 25. The bottom 27 and both sides of the retaining structure 2 are secured to interior of the main body 1 by stitching.

The suspension member 3 is slightly upwardly arcuate as viewed from a front end (i.e., convex) and comprises a lower fabric 31, an upper fabric 30, an upper magnetic member 33 of a first polarity which faces the first polarity of the lower magnetic member 23, a flexible board 32 formed on the upper magnetic member 33, a padding 34 sandwiched between the upper fabric 30 and the flexible board 32, and two spaced latches 35 projecting from either end.

The latches 35 are confined in the openings 26 and are adapted to slide therealong. In detail, the gravitational force of the notebook computer 4 pushes down the suspension member 3 and the latches 35 thus slide down along the openings 26. To the contrary, the repelling magnetic force between the magnetic members 23 and 33 due to same polarities counteracts the effects of the above gravitational force. As such, the suspension member 3 is suspended. This ensures a full protection of the received notebook computer 4 against damaging impacts and the like during transportation.

The strength of the magnetic force exerted by both the magnetic members 23 and 33 is designed to sufficiently support the notebook computer 4 in a suspended state. That is, the weight of a typical notebook computer should be taken into consideration in the design phase. Moreover, the strength of the magnetic force exerted by both ends of either magnetic member 23 or 33 should be greater than that exerted by an intermediate portion thereof because collision typically comes from either side of the carrying case. In addition, the magnetic members of same polarities can be mounted in both sides of the retaining structure 2 or in front and read surfaces thereof in other embodiments, or both.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A carrying case comprising:

a main body of rectangular configuration, said main body having a padded surface;

a U-shaped internal retaining structure dimensioned and shaped to receive a notebook computer, said internal retaining structure comprising an outer fabric, an inner fabric, an intermediate flexible board, a padding sandwiched between said outer fabric and said flexible board, a lower magnetic member of a first polarity sandwiched between said inner fabric and said flexible board, said U-shaped internal retaining structure having two rectangular projection members on both sides of said U-shaped internal retaining structure in proximity to either end of a bottom of said U-shaped internal retaining structure, and two parallel rectangular openings on either one of said projection members, said bottom and said both sides of said U-shaped internal retaining structure being secured to interior of said main body;

a suspension member comprising a lower fabric, an upper fabric, an upper magnetic member of a second polarity which faces said first polarity of said lower magnetic member, a flexible board formed on said upper magnetic member, a padding sandwiched between said upper fabric and said flexible board, and two spaced latches projecting from either end, said latches being confined in said openings and adapted to slide therealong;

wherein a gravitational force of said notebook computer rested upon said suspension member and confined by said U-shaped internal retaining structure pushes said suspension member to slide down said latches along said openings, and repelling force between said magnetic members counteracts effects of said gravitational force to suspend said suspension member.

2. The carrying bag as claimed in claim 1, wherein said bottom and said both sides of said U-shaped internal retaining structure are secured to said interior of said main body by stitching.

* * * * *